US010875305B2

(12) United States Patent
Nakakubo

(10) Patent No.: US 10,875,305 B2
(45) Date of Patent: Dec. 29, 2020

(54) LIQUID EJECTION HEAD

(71) Applicant: CANON KABUSHIKI KAISHA, Tokyo (JP)

(72) Inventor: Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/381,780

(22) Filed: Apr. 11, 2019

(65) Prior Publication Data

US 2019/0315123 A1 Oct. 17, 2019

(30) Foreign Application Priority Data

Apr. 17, 2018 (JP) ..... 2018-079105

(51) Int. Cl.
*B41J 2/14* (2006.01)

(52) U.S. Cl.
CPC ..... *B41J 2/1433* (2013.01); *B41J 2/14201* (2013.01)

(58) Field of Classification Search
None
See application file for complete search history.

(56) References Cited

U.S. PATENT DOCUMENTS

| | | | |
|---|---|---|---|
| 6,123,413 | A | 9/2000 | Agarwal et al. |
| 7,506,962 | B2 | 3/2009 | Murakami et al. |
| 8,371,685 | B2 | 2/2013 | Kusunoki et al. |
| 8,807,713 | B2 | 8/2014 | Nakamura et al. |
| 8,820,895 | B2 | 9/2014 | Bibl et al. |
| 8,985,748 | B2 | 3/2015 | Nakakubo |
| 9,278,368 | B2 | 3/2016 | Bibl et al. |
| 9,539,810 | B2 | 1/2017 | Tamura et al. |
| 9,573,370 | B2 | 2/2017 | Sasagawa et al. |
| 9,776,408 | B2 | 10/2017 | Bibl et al. |
| 10,112,393 | B2 | 10/2018 | Feinn et al. |
| 10,232,616 | B2 | 3/2019 | Nakakubo |
| 2008/0198208 | A1 | 8/2008 | Kyoso et al. |
| 2008/0238980 | A1 | 10/2008 | Nagashima et al. |

(Continued)

FOREIGN PATENT DOCUMENTS

| | | | |
|---|---|---|---|
| CN | 1191807 | A | 9/1998 |
| CN | 101316712 | A | 12/2008 |

(Continued)

OTHER PUBLICATIONS

Office Action dated Sep. 17, 2020, in Chinese Patent Application No. 201910306075.5.

*Primary Examiner* — Erica S Lin
(74) *Attorney, Agent, or Firm* — Venable LLP

(57) ABSTRACT

A liquid ejection head includes a substrate in which an ejection port for ejecting liquid is formed, a pressure chamber to house the liquid to be ejected from the ejection port and apply pressure to the liquid in the ejection, and a flow passage connected to the pressure chamber and configured to cause the liquid in the pressure chamber to circulate along the substrate. The ejection port has a non-circular shape, and the substrate is provided with a groove portion extending in a direction of the circulation and connected to the ejection port. According to the above-described configuration, the liquid ejection head can sufficiently extend a liquid circulation effect to a position near a meniscus while suppressing mixing of bubbles.

13 Claims, 10 Drawing Sheets

(56) References Cited

U.S. PATENT DOCUMENTS

| | | | | |
|---|---|---|---|---|
| 2013/0021411 | A1* | 1/2013 | Feinn | B41J 2/1433 347/47 |
| 2014/0359984 | A1 | 12/2014 | Kashu et al. | |
| 2015/0049141 | A1* | 2/2015 | Taff | B41J 2/1404 347/54 |
| 2018/0022093 | A1 | 1/2018 | Bibl et al. | |
| 2019/0001698 | A1 | 1/2019 | Yamazaki et al. | |

FOREIGN PATENT DOCUMENTS

| | | | |
|---|---|---|---|
| CN | 102905902 | A | 1/2013 |
| JP | 2008-149516 | A | 7/2008 |
| JP | 2010-194750 | A | 9/2010 |
| JP | 2012-532772 | A | 12/2012 |
| WO | 2013/162606 | A1 | 10/2013 |

* cited by examiner

LIQUID EJECTION HEAD

BACKGROUND OF THE INVENTION

Field of the Invention

The present invention relates to a liquid ejection head.

Description of the Related Art

Japanese Patent Laid-Open No. 2012-532772 discloses a configuration in which an inkjet printing head uses a thin-film piezoelectric element as an ejection energy generation element and ink circulates in a pressure chamber corresponding to each ejection port irrespective of whether ejection is performed or not. In Japanese Patent Laid-Open No. 2012-532772 as described above, a stable ejection operation can be maintained without bubbles and dust contained in the ink stagnating in an ejection portion.

Moreover, Japanese Patent Laid-Open No. 2010-194750 discloses the following technique: in a configuration in which ink circulates as in Japanese Patent Laid-Open No. 2012-532772, a meniscus is retreated to a position near the pressure chamber when no ejection signal is received. According to Japanese Patent Laid-Open No. 2010-194750, since the meniscus can be brought close to a circulation flow in the pressure chamber, an ink circulation effect can be extended to a position near the meniscus (edge of the liquid).

Furthermore, International Publication No. WO2013/162606 discloses a technique where a substrate in which an ejection port is formed is provided with a groove which extends in an ink circulation direction and which communicates with the ejection port. According to the configuration of International Publication No. WO2013/162606, the distance between the meniscus and the circulation flow in the pressure chamber can be reduced without moving the meniscus as in Japanese Patent Laid-Open No. 2010-194750 and the ink circulation effect can be extended to a position near the meniscus.

When the meniscus is retreated as in Japanese Patent Laid-Open No. 2010-194750, the risk that the meniscus exposed to the atmosphere takes in the atmosphere as bubbles rises. Moreover, when the groove is provided as in International Publication No. WO2013/162606, the risk that the bubbles taken in due to vibration of the meniscus are guided into the pressure chamber via the groove rises. Then, when the bubbles are mixed in the pressure chamber, there is a risk that an ejection operation performed thereafter is not properly performed.

In other words, in the conventional configuration, it has been difficult to sufficiently extend the effect of liquid circulation to a position near the meniscus while suppressing mixing of bubbles.

SUMMARY OF THE INVENTION

The present invention has been made to solve the aforementioned problems. Accordingly, an object of the present invention is to provide a liquid ejection head which can sufficiently extend a liquid circulation effect to a position near a meniscus while suppressing mixing of bubbles.

According to an aspect of the present invention, there is provided a liquid ejection head comprising:

a substrate in which an ejection port for ejecting liquid is formed;

a pressure chamber configured to house the liquid to be ejected from the ejection port and apply pressure to the liquid in the ejection; and a flow passage connected to the pressure chamber and configured to cause the liquid in the pressure chamber to circulate along the substrate, wherein the ejection port has a non-circular shape, and the substrate is provided with a groove portion extending in a direction of the circulation and connected to the ejection port.

Further features of the present invention will become apparent from the following description of exemplary embodiments with reference to the attached drawings.

DESCRIPTION OF THE EMBODIMENTS

First Embodiment

Figure 1:
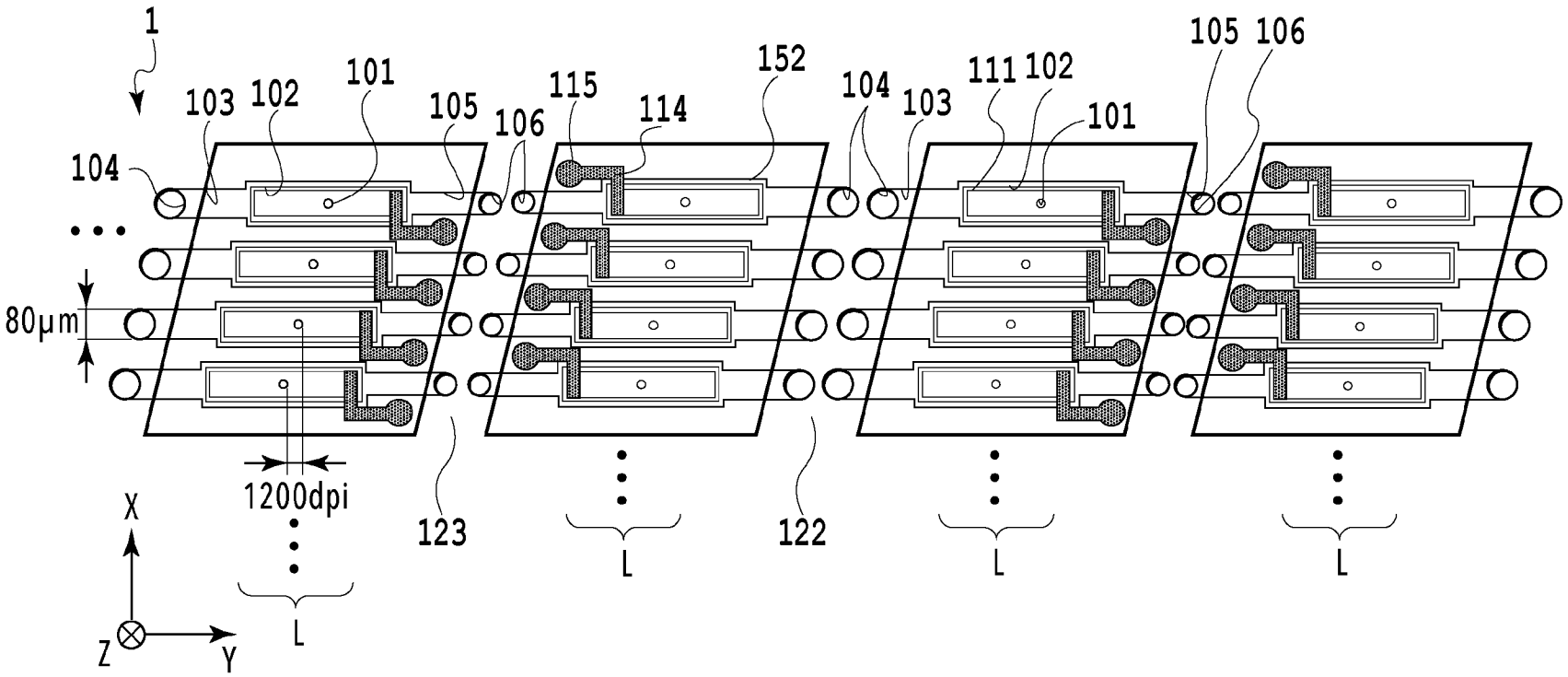
FIG. 1 is a plan view of a liquid ejection head.

FIG. 1 is a plan view (see-through drawing) of a liquid ejection head 1 usable in the present invention. In the liquid ejection head 1, multiple liquid ejection units 152 are laid out at predetermined intervals on a substrate made of a flat plate. In the embodiment, the liquid ejection units 152 each refer to a unit of mechanism for ejecting liquid as droplets.

In each liquid ejection unit 152, the liquid is supplied from a liquid supply port 104, flows through a liquid supply passage 103, a pressure chamber 102, and a liquid collection passage 105 in this order, and then is discharged from a liquid collection port 106. A piezoelectric element 111 configured to apply pressure to the liquid housed in the pressure chamber 102 in a Z direction is provided in the pressure chamber 102.

A lead-out line 114 extending parallel to the liquid collection passage 105 is connected to the liquid collection passage 105 side of the piezoelectric element 111 and a bump pad 115 is disposed in an end portion of the lead-out line 114. The liquid ejection unit 152 is configured such that, when voltage is applied to the piezoelectric element 111 in response to an ejection signal, the piezoelectric element 111 moves in the Z direction and part of the pressurized liquid in the pressure chamber 102 is ejected in the Z direction from an ejection port 101.

Each liquid ejection unit 152 has such a shape that the liquid supply passage 103, the pressure chamber 102, and the liquid collection passage 105 extend in a Y direction and, as illustrated in FIG. 1, the multiple liquid ejection units 152 are arranged two-dimensionally on an XY plane. Although FIG. 1 illustrates a state where ejection unit rows L are each formed of four liquid ejection units 152 arranged in an X direction and four ejection unit rows L are arranged in the Y direction, more liquid ejection units 152 are actually arranged in the X direction and the Y direction.

In the embodiment, two liquid ejection units 152 adjacent to each other in the X direction are arranged to be shifted from each other in the Y direction by a distance corresponding to 1200 dpi (about 21.5 μm). Thus, an image with a resolution of 1200 dpi can be printed on a printing medium by ejecting the liquid (ink) at a predetermined frequency from each ejection port 101 while moving the printing medium in the X direction at predetermined speed relative to the liquid ejection head 1.

Moreover, two ejection unit rows L adjacent to each other in the Y direction are each laid out in a state rotated by 180 degrees from another one, that is, laid out in point symmetry, and the liquid supply ports 104 or the liquid collection ports 106 are gathered between the adjacent two ejection unit rows L. Moreover, a common supply passage 122 configured to commonly supply the liquid to two ejection unit rows L and a common collection passage 123 configured to commonly collect the liquid from two ejection unit rows L are alternately arranged in the Y direction. The lead-out lines 114 are also gathered on the common collection passage 123 side. As described above, the liquid ejection head 1 of the embodiment is configured such that many liquid ejection units 152 are densely arranged while the flow passages of the liquid and the electrical lines are laid out as simply as possible.

Figure 2:
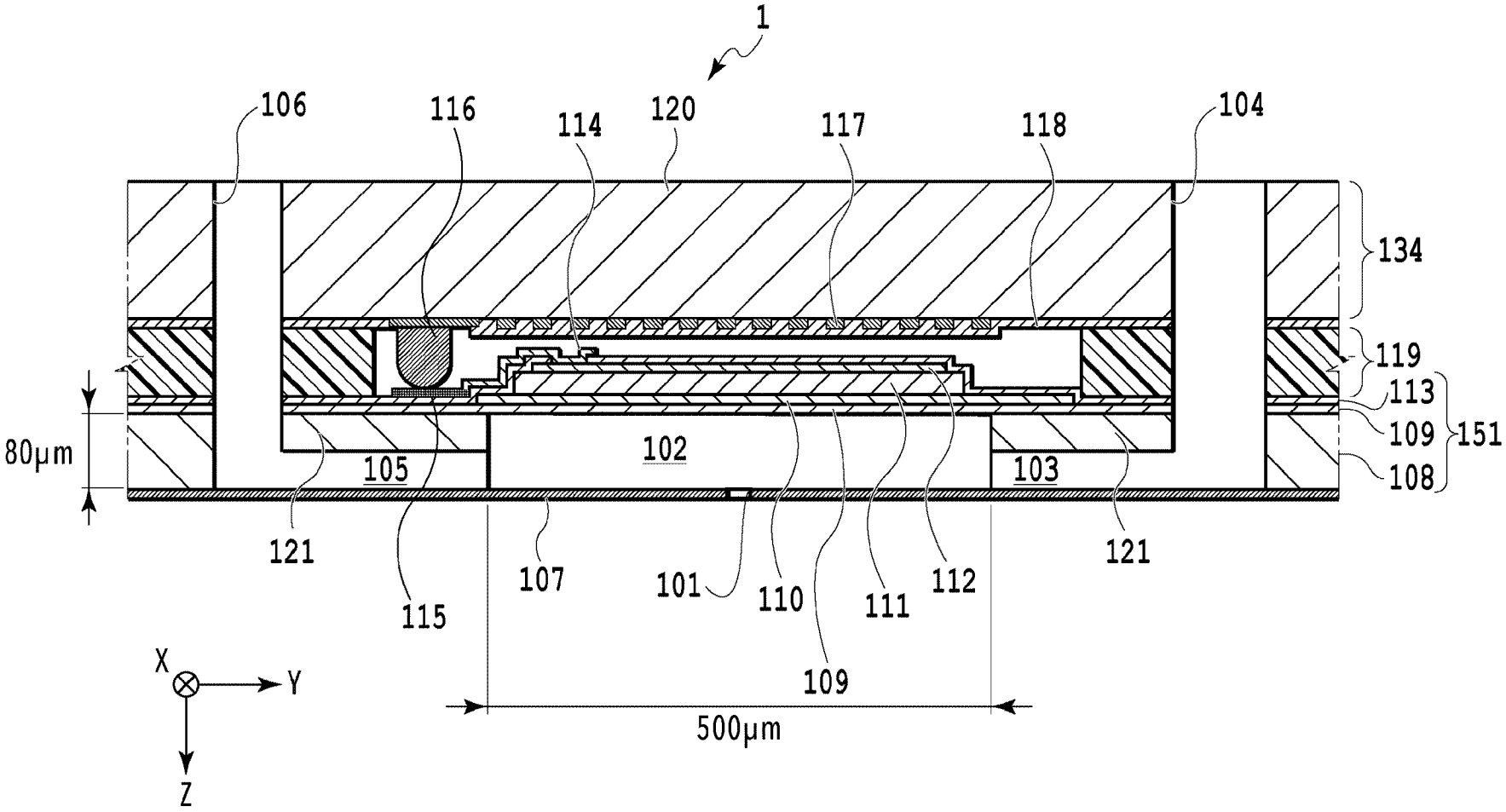
FIG. 2 is a cross-sectional view of a liquid ejection unit.

FIG. 2 is a cross-sectional view of one liquid ejection unit 152. The liquid ejection head 1 is basically formed by stacking three parts which are a liquid supply substrate 134, a photosensitive resin layer 119, and an element substrate 151 one on top of another. The element substrate 151 is a layer in which main components of the aforementioned liquid ejection unit 152 are two-dimensionally laid out on the XY plane. The liquid supply substrate 134 is a layer having a certain stiffness to support the liquid ejection units 152 while supplying and collecting the liquid to and from each liquid ejection unit 152. The photosensitive resin layer 119 joins the element substrate 151 and the liquid supply substrate 134 to each other and has a function of a spacer for housing elements and lines formed on these substrates.

The liquid supply substrate 134 is a silicon substrate and the liquid supply port 104 and the liquid collection port 106 are formed in the liquid supply substrate 134 by etching. An electrical line 117 and an electrically-conductive bump 116 connected to a not-illustrated control circuit are arranged between the liquid supply port 104 and the liquid collection port 106 on one surface (+Z direction side surface) of the liquid supply substrate 134. For example, an Au bump can be used as the electrically-conductive bump 116. The surface (+Z side surface) of the liquid supply substrate 134 is covered with a protection film 118 except for a portion to which the electrically-conductive bump 116 is electrically connected.

The element substrate 151 is formed by stacking a diaphragm 109 on a surface (−Z side surface) of a silicon substrate 108 and then stacking a common electrode 110, the piezoelectric element 111, and an individual electrode 112 in this order at a predetermined position (position corresponding to the pressure chamber 102) on the surface of the silicon substrate 108. The individual electrode 112 is electrically connected to the electrically-conductive bump 116 disposed on the liquid supply substrate 134, via the lead-out line 114 and the bump pad 115. The common electrode 110 extends from the +Z surface side of the piezoelectric element 111 to an end portion of the liquid ejection head 1 and is connected to the control circuit outside the liquid ejection head 1 via a bump (not illustrated) common to multiple liquid ejection units 152. Note that the element substrate 151 is also covered with a protection film 113 except for a portion to which the bump pad 115 is electrically connected.

Using the electrically-conductive bump 116 and the bump pad 115 as in the embodiment allows the line on the liquid supply substrate 134 side and the line on the element substrate 151 side to be easily connected to each other. However, the embodiment is not limited to a design using the electrically-conductive bump 116 and the bump pad 115. For example, the line on the liquid supply substrate 134 side and the line on the element substrate 151 side can be connected to each other also by using a penetration line.

The liquid supply passage 103, the pressure chamber 102, and the liquid collection passage 105 are formed on the back surface side (+Z side surface) of the silicon substrate 108 by etching. The liquid supply passage 103 is connected to the liquid supply port 104 and the liquid collection passage 105 is connected to the liquid collection port 106. The sizes and shapes of the liquid supply passage 103 and the liquid collection port 106 are defined by side walls 121 which are unetched portions of the silicon substrate 108. In the drawings, although only the side walls 121 defining the sizes in the Z direction (height direction) are illustrated, side walls disposed between the liquid ejection units 152 adjacent to each other in the X direction are also formed in the etching.

A nozzle substrate 107 in which the ejection ports 101 are formed is bonded to the +Z side surface of the silicon substrate 108 with the flow passage structures corresponding to the multiple liquid ejection units 152 formed as described above. The ejection ports 101 are arranged to correspond to the respective pressure chambers 102 and face the diaphragms 109 exposed by the etching.

The photosensitive resin layer 119 can be formed of a photosensitive dry film such as DF-470 (Hitachi Chemical Co, Ltd.), photosensitive liquid resist, a photosensitive film, or the like. Parts of the passages of the liquid supply port 104 and the liquid collection port 106 penetrating the photosensitive resin layer 119 to extend from the liquid supply substrate 134 to the element substrate 151 are formed in the photosensitive resin layer 119 by patterning using light. Using the photosensitive resin layer 119 as a layer having a role of a spacer allows joining of the element substrate 151 and the liquid supply substrate 134 and curing of the photosensitive resin layer 119 to be performed in one operation by utilizing heating and pressing performed in the connection of the electrically-conductive bump 116.

In the aforementioned configuration, the liquid fills the liquid supply port 104, the liquid supply passage 103, the pressure chamber 102, the liquid collection passage 105, and the liquid collection port 106 and circulates therein in this order. Since the flow passage cross section is reduced by the side walls 121 in the liquid supply passage 103 and the liquid collection passage 105, the liquid flows faster therein than in the liquid supply port 104 and the liquid collection port 106 and has a large force of inertia in the −Y direction.

A −Z direction surface of the piezoelectric element 111 is connected to the individual electrode 112 and a +Z direction surface of the piezoelectric element 111 is connected to the common electrode 110. Accordingly, when the control circuit applies a voltage pulse to the individual electrode 112 via the electrical line 117, the electrically-conductive bump 116, the bump pad 115, and the lead-out line 114, a potential difference is generated between the individual electrode 112 and the common electrode 110 and the piezoelectric element 111 bulges in an out-of-plane direction. With this bulging, the diaphragm 109 moves in the Z direction to reduce the volume of the pressure chamber 102, and part of the pressurized liquid is ejected from the ejection port 101 in the +Z direction. In this case, since the force of inertia of the liquid flowing from the liquid supply passage 103 to the liquid collection passage 105 is sufficiently large, the pressure applied to the liquid by the piezoelectric element 111 does not affect the flow of the liquid in the liquid supply passage 103 and the liquid collection passage 105.

In the liquid ejection head 1 of the embodiment, the piezoelectric element 111 can be driven for various applications in addition to the droplet ejection operation. For example, as described in Japanese Patent Laid-Open No. 2010-194750, the piezoelectric element 111 can be driven to cause a meniscus to retreat when no ejection signal is received. Moreover, the piezoelectric element 111 can be driven at timing synchronized with the Helmholtz resonance frequency of the pressure chamber 102 to control the droplet ejection amount or reduce generation of satellite droplets in the ejection operation. Furthermore, the piezoelectric element 111 can be driven to suppress residual vibration in the pressure chamber 102 after the ejection of droplets, by causing vibration of such a degree that no liquid is ejected.

Brief description is given of a phenomenon in which bubbles are mixed in the liquid due to vibration of the meniscus. Generally, when liquid is made to vibrate in a tubular passage with the meniscus exposed to the atmosphere in the forefront, the atmosphere is more likely to be mixed into the liquid in a portion near an inner wall of the tube than in a center portion of a tube cross section. In the studies made by the present inventors, it was found that: the flow rate at an inner wall surface was almost zero and thus almost no atmosphere was mixed into the liquid; however, particularly in a portion near the inner wall surface (specifically, a region 3 to 10 μm away from the inner wall surface toward the center of the tube cross section), the atmosphere is likely be taken into the liquid. Accordingly, the risk of bubbles being mixed into the pressure chamber can be kept low by making the flow resistance of the inner wall (edge of the nozzle) of the tube as high as possible and reducing the flow rate in the portion near the inner wall surface.

Generally, "hydraulic mean depth" which is a physical quantity with a dimension of length is known as a dimension used for studying the flow resistance of a tubular passage. A tube friction coefficient of a tubular passage is proportional to the "hydraulic mean depth." The "hydraulic mean depth" is defined by the following formula.

(hydraulic mean depth)=(flow passage cross-sectional area)/(length of wet edge of flow passage cross section)

In the study of "hydraulic mean depth," a cross-sectional shape with the smallest cross-sectional area of a tubular passage among various cross-sectional shapes with a certain flow resistance is a circle. In other words, when fluid is made to flow through various tubes with the same flow resistance, the average flow rate per unit area is highest in a circular tube. Furthermore, in the circular tube, the flow rate is highest at the center of the circular cross-section and decreases toward an outer edge portion.

In a tube which does not have a circular cross section, it is assumed that the flow rate is highest at the center of a largest circle inscribed in the cross section of the tube and decreases as the distance from the center of the circle increases. Specifically, it is possible to keep the flow rate near the edge of the ejection port low and suppress mixing of bubbles due to the vibration of meniscus by adjusting the shape of the ejection port such that many regions of the edge portion are located away from the inscribed circle. Furthermore, if the ejection port with such a shape can be prepared, the bubbles guided to the pressure chamber via a groove portion connected to the ejection port can be reduced even when such a groove portion is provided. Thus, it is possible to achieve both the suppression of the mixing of the bubbles and improvements in a circulation effect of the liquid.

Figure 3:
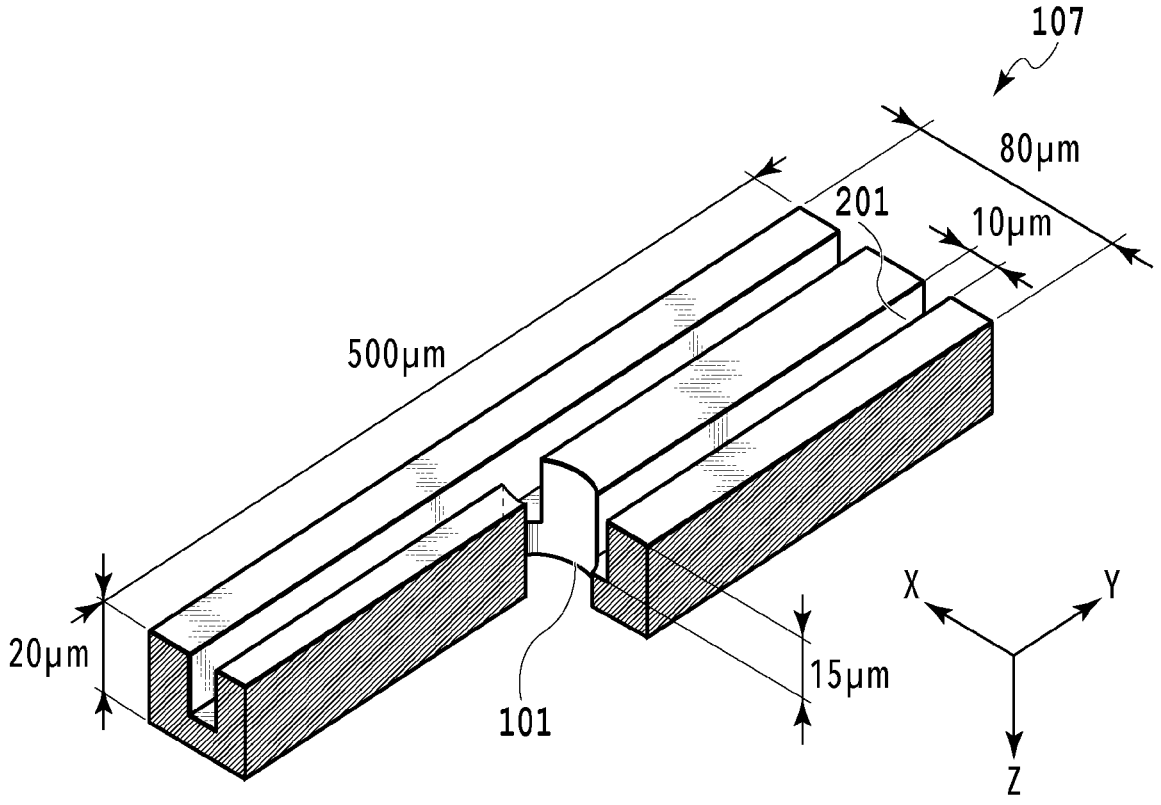
FIG. 3 is a view illustrating a detailed configuration of a nozzle substrate in a first embodiment.

FIG. 3 is a view illustrating a detailed configuration of the nozzle substrate 107 in the embodiment. Although the nozzle substrate 107 in the embodiment is one substrate common to multiple liquid ejection units, only the region corresponding to one pressure chamber 102 is illustrated as a ¾ cross-sectional view. Each pressure chamber 102 is assumed to have dimensions of 500 μm in the Y direction, 80 μm in the X direction, and 80 μm in the Z direction. Accordingly, also for the nozzle substrate 107 illustrated in FIG. 3, a region of 500 μm in the Y direction and 80 μm in the X direction with the ejection port 101 at the center is illustrated. Note that the Z direction thickness of the nozzle substrate 107 is assumed to be 20 μm.

Two groove portions 201 extending in the Y direction are formed in the nozzle substrate 107 of the embodiment. The two groove portions 201 have the same shape and each have the X direction width of 10 μm, the Y direction length of 500 μm, and the Z direction depth of 15 μm.

Figures 4A, 4B:
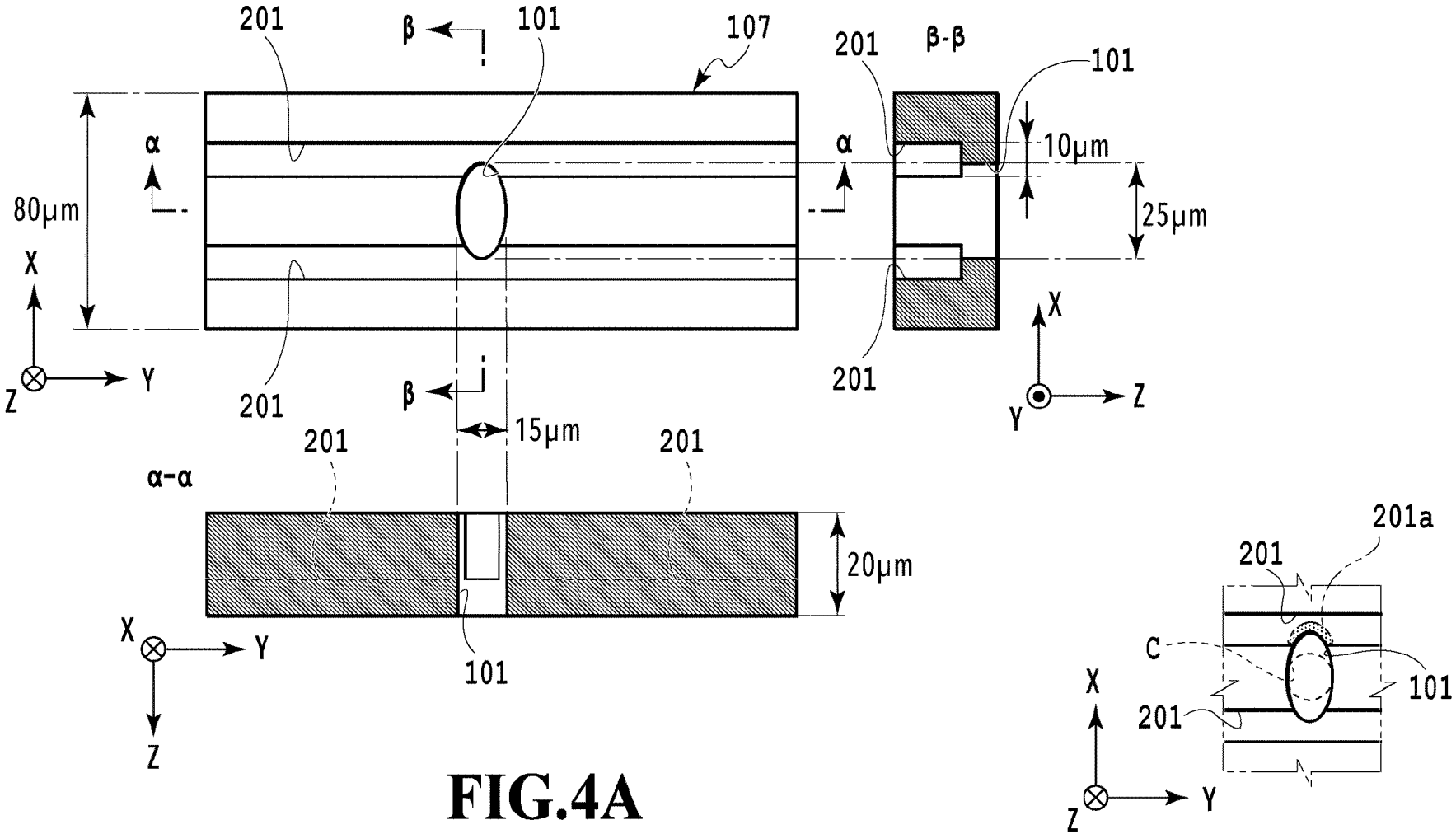
FIGS. 4A and 4B are views illustrating details of the nozzle substrate and the shape of an ejection port.

FIG. 4A includes a plan view and cross-sectional views of the aforementioned nozzle substrate 107 and FIG. 4B is a view illustrating details of the shape of the ejection port 101. The ejection port 101 of the embodiment has an elliptical shape with a major axis extending in the X direction and a minor axis extending in the Y direction orthogonal to the major axis. The length of the major axis (X direction) is 25 μm and the length of the minor axis (Y direction) is 15 μm. Both end portions in the major axis direction (X-axis direction) are included in regions of two groove portions 201 and such regions are hereafter referred to as overlapping regions in the specification. The shapes and positions of the two groove portions 201 and the ejection port 101 are symmetrical with respect to the center axis.

Such a nozzle substrate 107 can be formed by using, for example, an Si substrate as a material and forming the ejection port 101 and the groove portions 201 by photolithography and dry etching (Deep Reactive Ion Etching; DRIE).

Since the nozzle substrate 107 has sufficient thickness of 20 μm, the nozzle substrate 107 can sufficiently withstand pressure generated by vibration of the diaphragm 109 even when two groove portions 201 are formed. Specifically, when the piezoelectric element 111 is driven, the pressure obtained from the diaphragm 109 can be efficiently utilized for the ejection operation from the ejection port.

In FIG. 4B, an inscribed circle C in contact with an edge portion of the ejection port 101 having the elliptical shape is illustrated by a dotted line. In the elliptical ejection port edge portion, the flow rate is high near contact points with the inscribed circle C and the risk of mixing of bubbles is high. However, in the ejection port 101 of the embodiment, the edge portion comes into contact with the inscribed circle C only at two points in the minor axis (Y-axis) direction. Specifically, forming the ejection port 101 in the elliptical shape causes most of the regions of the edge portion to be arranged away from the inscribed circle C and this can reduce the flow rate near the edge portion and suppress the risk of the meniscus taking in the atmosphere.

In addition, in the embodiment, the groove portions 201 are formed such that portions farthest from the inscribed circle (both ends of the major axis), that is, portions where the flow rate is lowest, are the overlapping regions 201*a*, and the liquid circulation effect near the ejection port is thereby improved. The nozzle substrate 107 in the groove portions 201 is thin and the thickness thereof is 5 μm. Accordingly, the meniscus is sufficiently near a circulation flow passing through the groove portions 201 and the circulation effect in the groove portions 201 extends to regions near the meniscus. As a result, fresh liquid can be stably supplied to the nozzles with the circulation.

As described above, in the embodiment, there is used the nozzle substrate in which the ejection port has the elliptical shape and the two grooves are formed such that both ends of the major axis of the elliptical ejection port are the overlapping regions. This improves the liquid circulation effect while suppressing the mixing of bubbles due to vibration of the meniscus and a stable ejection operation can be maintained in the liquid ejection head.

Figure 5A:
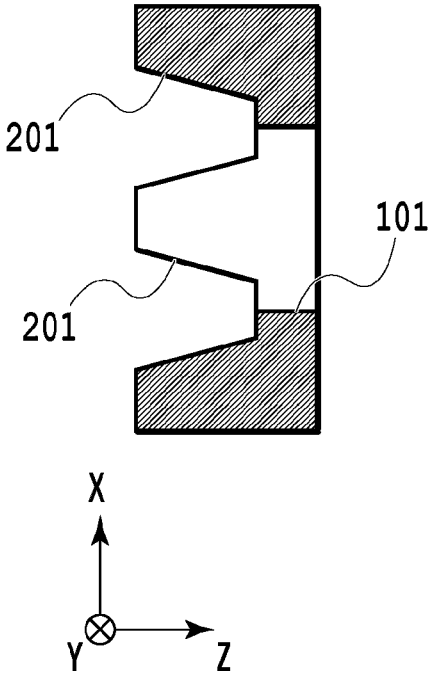
FIGS. 5A and 5B are views illustrating a modified example of groove portions in the first embodiment.
Figure 5B:
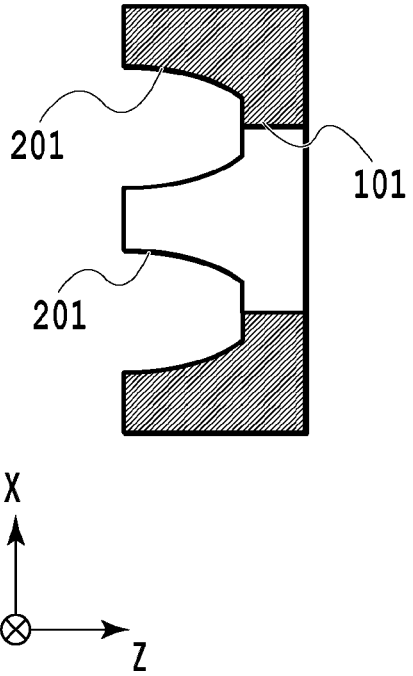

FIGS. 5A and 5B are views illustrating modified examples of the groove portions 201 which can be employed in the embodiment. Although the groove portions 201 of FIG. 4A have a rectangular shape, the groove portions 201 of FIGS. 5A and 5B have shapes in which the width thereof on the pressure chamber side (−Z direction side) is greater than the width on the ejection port side (+Z direction side). Using such groove portions 201 can further increase the circulation flow rate in the groove portions 201 and further improve the liquid circulation effect near the ejection port 101.

FIGS. 6A to 6E are views illustrating modified examples of the ejection port 101 and the groove portions 201 which can be employed in the embodiment. In FIGS. 6A to 6E, broken lines illustrate circular regions (inscribed circles C) which are inscribed in the ejection port 101 and in which the average flow rate is relatively high.

Figure 6A:
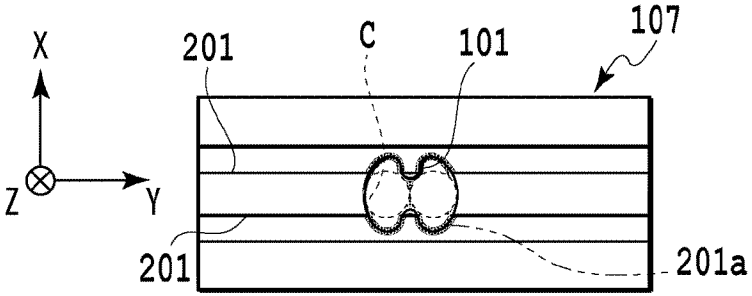
FIGS. 6A to 6E are views illustrating modified examples of the ejection port and the groove portions.

FIG. 6A illustrates the ejection port 101 with a shape in which protruding portions are arranged at both ends of a circular opening in the X direction. Providing such protruding portions can increase the flow passage resistance of the entire ejection port 101 even if the ejection port has a circular basic shape. In this modified example, two inscribed circles of the ejection port are arranged side by side in the Y direction. Also, in such an ejection port shape, most of the regions of the edge portion are made to be arranged away from the inscribed circles C and this can reduce the flow rate near the edge portion and suppress the risk of the meniscus taking in the atmosphere. Moreover, as in the mode of FIGS. 4A and 4B, forming the groove portions 201 such that portions farthest from the inscribed circles are the overlapping regions 201*a* can improve the liquid circulation effect near the ejection port.

Note that, although there are portions coming into contact with the inscribed circles C near ends of the two protruding portions, the distance between the protruding portions facing each other is very small and the liquid tends to flow in by capillary force. Accordingly, the risk of air bubbles being mixed into the liquid from these portions is small.

Figure 6B:
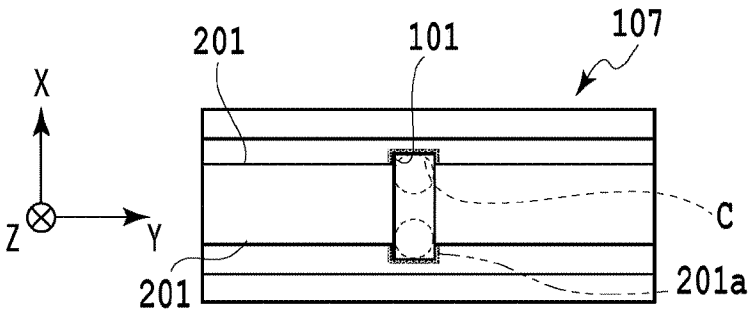
Figure 6C:
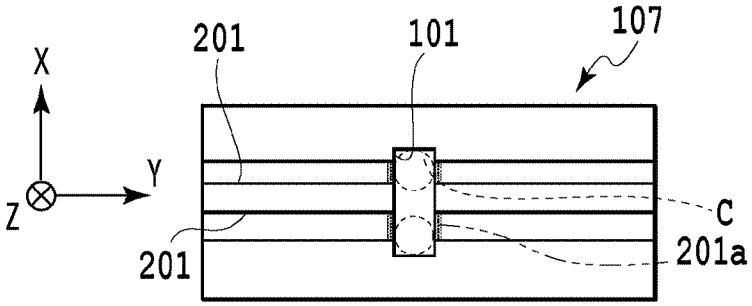
Figure 6D:
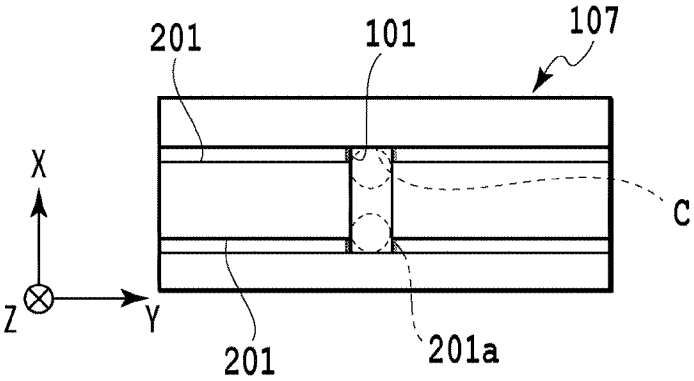

FIGS. 6B to 6D each illustrate a rectangular ejection port having a major axis (long sides) and a minor axis (short sides) with the same lengths as those in the ellipse illustrated in FIGS. 4A and 4B. When the ejection port has a rectangular shape, multiple inscribed circles are arranged side by side in the X direction.

The positions of the overlapping regions 201*a* between the two groove portions 201 and the ejection port 101 vary among FIGS. 6B to 6D. In FIG. 6B, the entire short sides of the ejection port 101 are the overlapping regions 201*a*. In FIG. 6C, regions being part of the long sides of the ejection port 101 and including contact points with the inscribed circles C are the overlapping regions 201*a*. In FIG. 6D, regions being part of the long sides of the ejection port 101 and including no contact points with the inscribed circles C are the overlapping regions 201*a*.

In each of FIGS. 6B to 6D, since the ejection port has a non-circular shape, the mixing of bubbles due to meniscus vibration can be suppressed. However, in the comparison among FIGS. 6B to 6D, the configuration of the FIG. 6D in which the overlapping regions 201*a* include no contact points with the inscribed circles C is most preferable from the viewpoint that the generated bubbles are less likely to be guided into the pressure chamber.

Figure 6E:
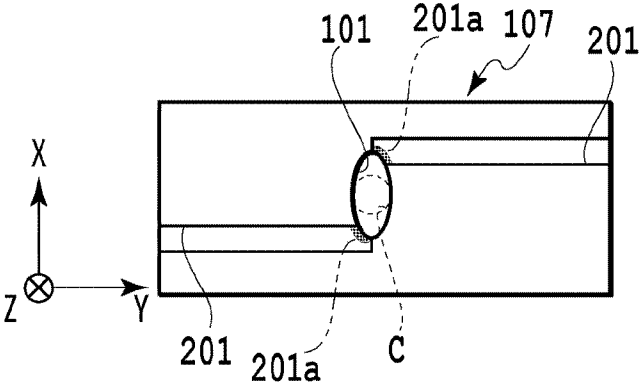

FIG. 6E illustrates the case where the ejection port 101 has the same elliptical shape as in FIGS. 4A and 4B and the layout of the groove portions 201 is different from that in FIGS. 4A and 4B. In this modified example, the groove portion 201 on the +X side extends from the ejection port 101 only in the +Y direction and the groove portion 201 on the −X side extends from the ejection port 101 only in the −Y direction. In such a configuration, the liquid supplied from the +Y side along the groove portion 201 on the +X side moves inside the ejection port 101 from the +X side to the −X side and then moves toward the −Y side along the groove portion 201 on the −X side. As a result, the liquid in the ejection port 101 can be more efficiently replaced.

Second Embodiment

Also, in a liquid ejection head 1 of a second embodiment, multiple liquid ejection units 152 are arranged in the layout illustrated in FIG. 1 and have a cross-sectional view illustrated in FIG. 2.

Figure 7:
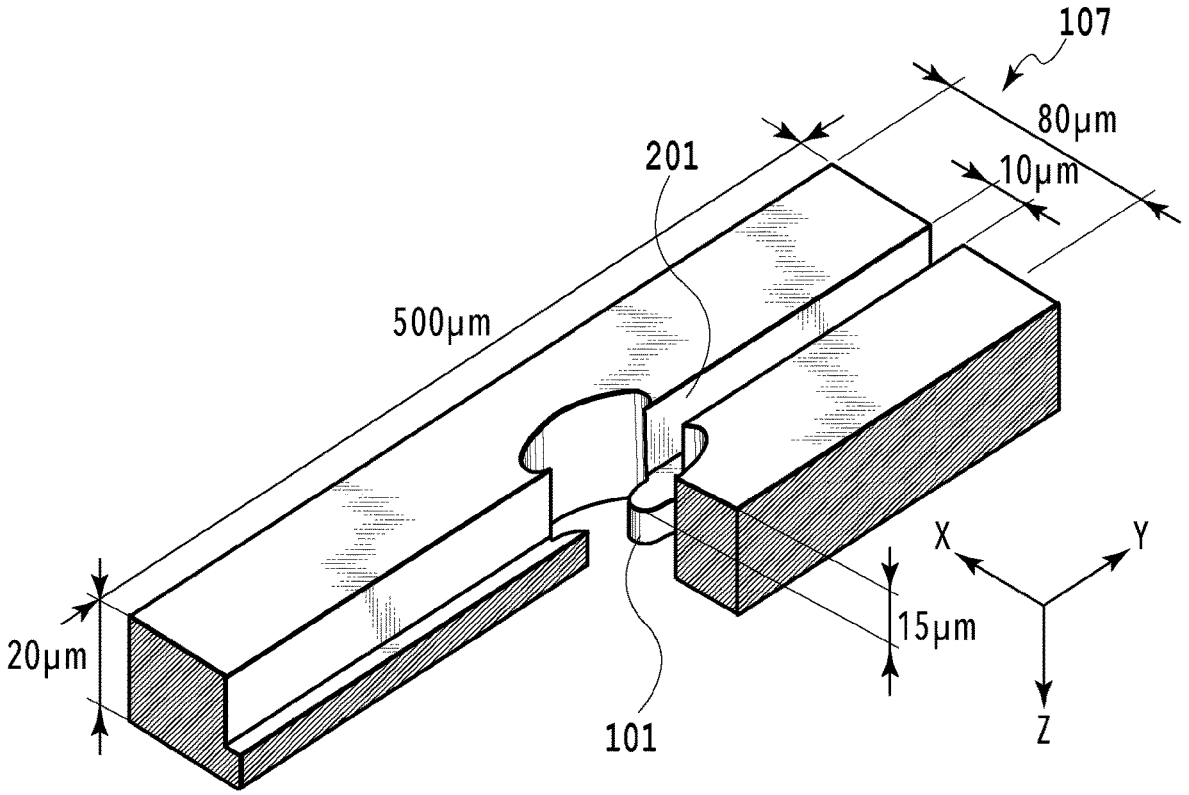
FIG. 7 is a view illustrating a detailed configuration of a nozzle substrate in a second embodiment.

FIG. 7 is a configurational view of a nozzle substrate 107 employed in the embodiment. The nozzle substrate 107 in the embodiment also has a thickness of 20 μm and a region of 500 μm in the Y direction and 80 μm in the X direction corresponds to the pressure chamber.

Although two groove portions 201 are arranged for one ejection port 101 in the first embodiment, in this embodiment, one groove portion 201 is arranged for one ejection port 101 to pass the center of the ejection port 101. The width (10 μm) and the depth (15 μm) of the groove portion 201 are the same as those in the first embodiment.

Figure 8:
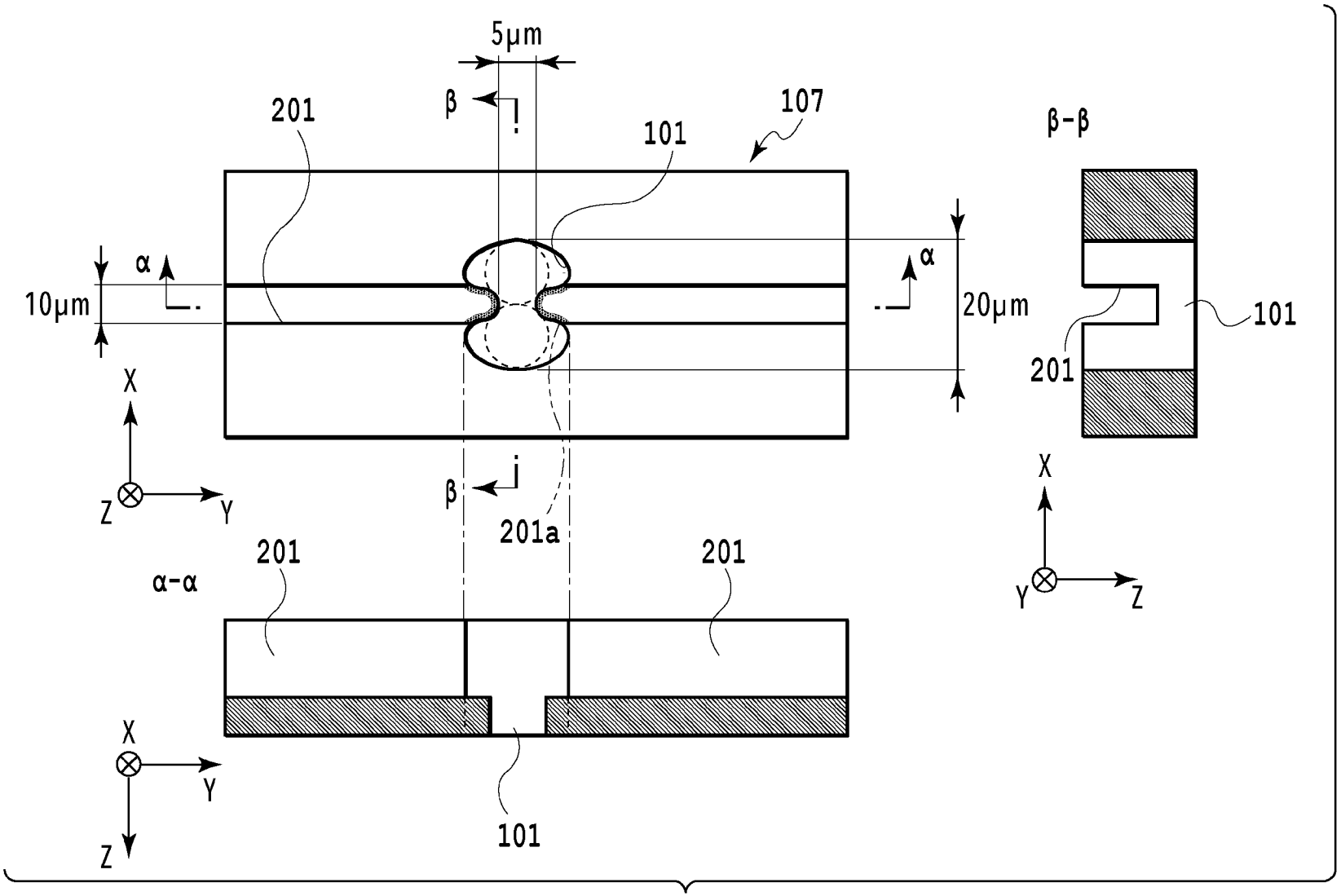
FIG. 8 is a view illustrating details of the nozzle substrate and the shape of the ejection port.

FIG. 8 includes a plan view and cross-sectional views of the nozzle substrate 107 in the embodiment. The ejection port 101 of the embodiment has a shape in which protruding portions protruding inward from both ends in the X direction and having a width of 5 μm and a radius of curvature of 2.5 μm are arranged for a circular opening having a diameter of 20 μm. The distance between the two protruding portions facing each other is 5 μm. Providing such protruding portions can increase the flow resistance and suppress the average flow rate of the entire ejection port even when the ejection port has a circular basic shape.

In the embodiment, two inscribed circles C in which the flow rate is relatively high are arranged in the X direction. Since most of the regions of the edge portion of the ejection port 101 are not in contact with the inscribed circles C as in the first embodiment, the risk of the mixing of bubbles can be kept low.

In the embodiment, the groove portion 201 is formed in a center region in which the flow rate is reduced by the protruding portions, and the liquid circulation effect in the ejection port is improved. Since the liquid circulating in the groove portion 201 passes the center of the ejection port 101, the liquid in the ejection port 101 can be more efficiently replaced. Note that, although there are portions where the two protruding portions come into contact with the inscribed circles C near ends of the protruding portions, the distance between the protruding portions facing each other is 5 μm and is very small. Accordingly, the liquid is likely to flow in by capillary force and the risk of air bubbles mixing in from these portions is low.

Figure 9:
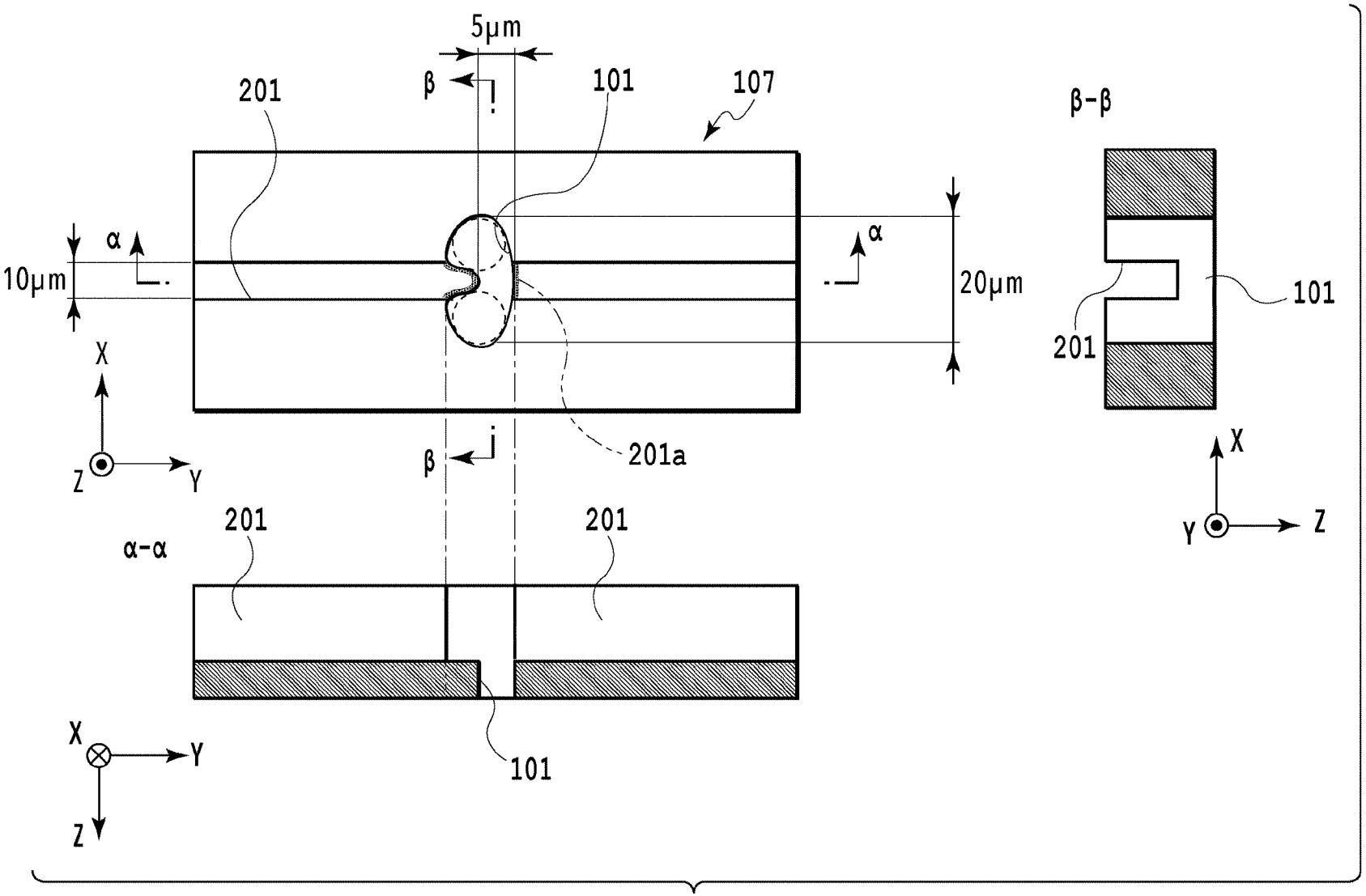
FIG. 9 is a view illustrating a modified example of the ejection port in the second embodiment.

FIG. 9 is a view illustrating a modified example of the ejection port 101 which can be employed in the embodiment. The ejection port 101 of the modified example has a shape in which the elliptic opening described in the first embodiment is provided and a protruding portion with a width of 5 μm and a radius of curvature of 2.5 μm is arranged on one side of the elliptic opening in the X direction.

Since the flow resistance in the center portion of the ejection port is increased and the flow rate is thus reduced from those in the elliptic shape described in the first embodiment by amounts corresponding to arranging of the protruding portion, the mixing of bubbles due to meniscus vibration can be suppressed even when the groove portion 201 is formed to pass the center portion of the ejection port 101. In addition, since the circulation flow in the groove portion 201 can be made to pass the center of the ejection port 101, the liquid in the ejection port 101 can be more efficiently replaced.

Figure 10:
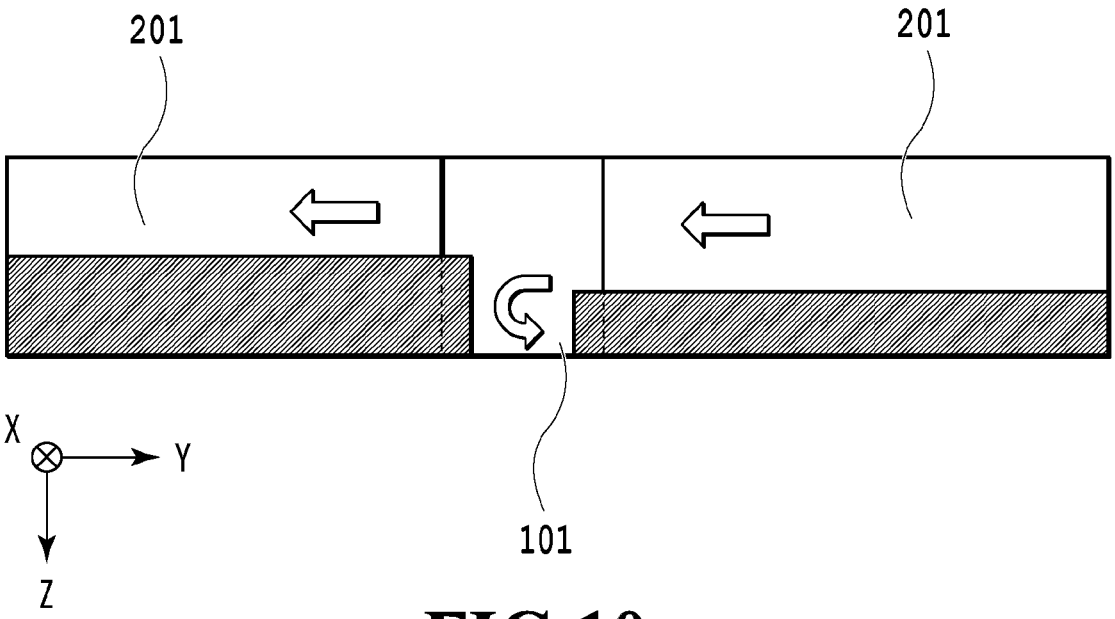
FIG. 10 is a view illustrating a modified example of the groove portion in the second embodiment.

FIG. 10 is a view illustrating a modified example of the groove portion 201 which can be employed in the embodiment. FIG. 10 corresponds to a cross-sectional view along the line α-α in FIG. 8. Note that the top view of the modified example is the same as FIG. 8. The modified example is different from the second embodiment described in FIG. 8 in that the groove portion 201 upstream (on the +Y direction side) of the ejection port 101 in the circulation flow direction is deeper than the groove portion 201 downstream (on the −Y direction side) of the ejection port 101 in the circulation flow direction. In such a modified example, the liquid flowing through the upstream groove portion 201 hits a wall surface of a bottom portion of the downstream groove portion 201 and swirls near the ejection portion 101 as illustrated by the arrow in FIG. 10. The liquid in the ejection port 101 can be thus more efficiently replaced.

As described above, in the embodiment, there is used the nozzle substrate in which the protruding portions are arranged in the ejection port and the one groove is formed such that the portions where these protruding portions are arranged are included in the overlapping region. This improves the liquid circulation effect while suppressing the mixing of bubbles due to vibration of the meniscus and a stable ejection operation can be maintained in the liquid ejection head.

Other Embodiments

Although the groove portion 201 extending with the uniform width over the entire longitudinal direction of the pressure chamber 102 is prepared in the nozzle substrate 107 in the aforementioned embodiments, the present invention is not limited to such a mode. Even if the groove portion does not extend over the entire pressure chamber, an effect of the present invention which is efficiently circulating the liquid near the ejection port can be obtained as long as at least one groove portion is formed to be connected to the ejection port 101. In this case, the length and depth of the groove portion are preferably adjusted while keeping balance between the liquid circulation efficiency and the stiffness of the nozzle substrate. Note that, as preferable conditions, there are given a condition that the groove portion is arranged at least upstream of the ejection port in the circulation direction and a condition that the length of the groove portion in the circulation direction is twice or more than the depth of the groove portion. Moreover, the depth and width of the groove portion may gradually change in the circulation direction.

Although the configuration using the piezoelectric element 111 and the diaphragm 109 as elements for generating the ejection energy is described above, the liquid ejection head of the present invention is not limited to such a configuration. For example, also in a thermal liquid ejection head using a thermoelectric conversion element as the ejection energy generation element, an effect of the present invention which is improving the liquid circulation efficiency while suppressing the mixing of bubbles can be obtained as long as a non-circular ejection port and a groove portion connected to the ejection port are arranged in the nozzle substrate.

In any case, forming the ejection port in a non-circular shape and disposing at least one groove portion connected to the ejection portion can cause the liquid circulation effect to extend to a portion near the meniscus while suppressing the mixing of bubbles due to vibration of the meniscus. As a result, a stable ejection operation can be maintained in the liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-079105, filed Apr. 17, 2018, which is hereby incorporated by reference wherein herein in its entirety.

What is claimed is:

1. A liquid ejection head comprising:

a substrate in which an ejection port for ejecting liquid is formed;

a pressure chamber configured to house the liquid to be ejected from the ejection port and apply pressure to the liquid in the ejection; and a flow passage connected to the pressure chamber and configured to cause the liquid in the pressure chamber to circulate along the substrate, wherein the ejection port has a non-circular shape, and the substrate is provided with a first groove portion connected to one end portion of the ejection port and a second groove portion connected to the other end portion of the ejection port, the first groove portion and the second groove portion extending in a direction of the circulation.

2. The liquid ejection head according to claim 1, wherein at least one of the first and second groove portions is connected to an edge portion of the ejection port at a position different from a region in which an average flow rate of the ejection port is highest.

3. The liquid ejection head according to claim 1, wherein at least one of the first and second groove portions is connected to an edge portion of the ejection port at a position which does not include a contact point with a largest circle inscribed in the edge portion.

4. The liquid ejection head according to claim 1, wherein the shape of the ejection port is an ellipse or a rectangle which is longer in a direction orthogonal to the direction of the circulation than in the direction of the circulation.

5. The liquid ejection head according to claim 1, wherein an edge portion of the ejection port has a protruding portion protruding inward.

6. The liquid ejection head according to claim 5, wherein at least one of the first and second groove portions is connected to the edge portion of the ejection port at a position including a region of the protruding portion.

7. The liquid ejection head according to claim 5, wherein a plurality of protruding portions are arranged to face each other on the edge portion of the ejection port.

8. The liquid ejection head according to claim 1, wherein the substrate is provided with only one of the first and second groove portions connected to the ejection port.

9. The liquid ejection head according to claim 1, wherein the first and second groove portions are parallel to each other.

10. The liquid ejection head according to claim 1, wherein one of the first and second groove portions is connected to the ejection port upstream with respect to the direction of the circulation and the other of the first and second groove portions is connected to the ejection port downstream with respect to the direction of the circulation.

11. The liquid ejection head according to claim 1, further comprising a piezoelectric element configured to reduce a volume of the pressure chamber, wherein the liquid in the pressure chamber is ejected from the ejection port by driving the piezoelectric element.

12. The liquid ejection head according to claim 11, wherein, when an ejection operation is not performed, a meniscus formed in the ejection port is retreated in a direction toward the pressure chamber.

13. The liquid ejection head according to claim 11, wherein, when an ejection operation is not performed, a meniscus formed in the ejection port is made to vibrate at a level without ejecting the liquid.

* * * * *